US009802111B2

(12) United States Patent
Bartolomucci et al.

(10) Patent No.: US 9,802,111 B2
(45) Date of Patent: Oct. 31, 2017

(54) STROKER'S AID AND METHOD OF USING THE SAME

(71) Applicants: Dino V. Bartolomucci, Coraopolis, PA (US); Kenneth Charles Baurle, Pittsburgh, PA (US)

(72) Inventors: Dino V. Bartolomucci, Coraopolis, PA (US); Kenneth Charles Baurle, Pittsburgh, PA (US)

( * ) Notice: Subject to any disclaimer, the term of this patent is extended or adjusted under 35 U.S.C. 154(b) by 0 days.

(21) Appl. No.: 15/050,978

(22) Filed: Feb. 23, 2016

(65) Prior Publication Data

US 2016/0296831 A1 Oct. 13, 2016

Related U.S. Application Data

(60) Provisional application No. 62/144,458, filed on Apr. 8, 2015.

(51) Int. Cl.
*A63D 15/10* (2006.01)

(52) U.S. Cl.
CPC ..... *A63D 15/105* (2013.01)

(58) Field of Classification Search
CPC ..... A63D 15/105
USPC ..... 473/42, 43; D21/684
See application file for complete search history.

(56) References Cited

U.S. PATENT DOCUMENTS 242,877 A * 6/1881 Bryant ..... A63D 15/105 473/43
570,459 A * 11/1896 Cronin ..... A63D 15/105 2/16
1,105,478 A 7/1914 Ames
1,149,834 A * 8/1915 James ..... A63D 15/105 2/16
3,544,111 A * 12/1970 Kluber ..... A63D 15/006 473/43
3,563,543 A * 2/1971 Hamilton ..... A63D 15/105 473/43
3,851,876 A 12/1974 Baker
4,053,153 A * 10/1977 Josenhans ..... A63D 15/105 473/43
4,210,325 A * 7/1980 McCann ..... A63D 15/105 473/43
4,629,187 A * 12/1986 Mirowski ..... A63D 15/105 473/43
4,953,860 A * 9/1990 Ames ..... A63D 15/105 473/42

(Continued)

OTHER PUBLICATIONS

International Search Report for PCT/US2016/026142 dated Jul. 13, 2016.

(Continued)

*Primary Examiner* — Mark Graham
(74) *Attorney, Agent, or Firm* — Buchanan Ingersoll & Rooney PC

(57) ABSTRACT

A device that is configured to be usable to assist a user in moving a cue member (e.g. a pool cue or cue stick) that is sized and configured to strike a ball for a game of pool or billiards can include a stabilizer element, a ring element attached to the stabilizer element, and a rest defining a first aperture along which a cue stick or other cue member is slideable. A method of using the device is configured so that the device can be used for hitting a ball in a game of pool or billiards by sliding a cue member along an aperture defined by the rest.

20 Claims, 3 Drawing Sheets

(56) References Cited

U.S. PATENT DOCUMENTS

| | | | | | |
|---|---|---|---|---|---|
| 5,165,681 | A * | 11/1992 | Enger | A63D 15/105 | 473/36 |
| 5,474,502 | A * | 12/1995 | Brown | A63D 15/105 | 473/42 |
| D768,790 | S * | 10/2016 | Croci | D21/684 | |
| 2003/0211897 | A1* | 11/2003 | Morton | A63D 15/105 | 473/42 |
| 2006/0025228 | A1* | 2/2006 | Light | A63D 15/105 | 473/42 |
| 2007/0178981 | A1* | 8/2007 | Grainger | A63D 15/105 | 473/42 |
| 2010/0311511 | A1 | 12/2010 | Crump et al. | | |
| 2015/0297977 | A1* | 10/2015 | Buckhault | A63D 15/105 | 473/43 |

OTHER PUBLICATIONS

Written Opinion of the International Searching Authority for PCT/US2016/026142 dated Jul. 13, 2016.

* cited by examiner

STROKER'S AID AND METHOD OF USING THE SAME

CROSS-REFERENCE TO RELATED APPLICATIONS

The present application claims priority to U.S. Provisional Patent Application No. 62/144,458, which was filed on Apr. 8, 2015. The entirety of this provisional patent application is incorporated by reference herein.

FIELD OF INVENTION

The present invention relates to a stroker's aid for use of a cue stick or other elongated cue element that may be used to strike a ball when playing pool or billiards. In some embodiments, the stroker's aid can be configured as a cue holder rest or other type of aid for assisting in the use of a cue to strike a ball during a billiards sports game.

BACKGROUND OF THE INVENTION

Billiards sports games (e.g. eight ball, nine ball, ten ball, straight pool, black ball, snooker, etc.) often involve at least one player using a cue, which may also be referred to as a cue stick, to strike a ball. U.S. Pat. Nos. 570,459, 635,569, 1,482,962, 1,604,023, 3,563,543, 3,851,876, 4,147,346, 4,634,123, 5,141,225, 5,238,457, 5,554,075, and 5,853,333; and U.S. Patent Application Publication No. 2008/0125233 disclose examples of billiard sports devices. Such devices may be used during a billiards sports game, such as a game of pool or other type of billiards game.

SUMMARY OF THE INVENTION

We have developed a new device that is usable to help assist a user in moving a cue stick (e.g. a pool cue) or other cue member sized and configured to strike a ball for a game of pool or billiards. Embodiments of our device can be configured so that a use may hold the device in one hand and use his or her other hand to strike a ball with a cue stick or other cue element used to strike a ball for a game of billiards or pool. In some embodiments, the device can include an elongated stabilizer that may be grasped by one or more fingers of a user's hand (e.g. the pinky, fore finger and middle finger) or that may be retained in the palm of a user's hand as the user's fingers extend generally forwardly to support the device and hand on a surface. A ring element can be attached to the stabilizer that has an aperture through which a user's pointer finger or other finger may be positioned to facilitate the holding or control of the device. A rest attached to the ring element and/or the stabilizer can have a groove or other type of aperture along which a cue stick or other cue element used to strike a ball for a game of billiards or pool can be slid along when moving the cue stick or cue element to strike a ball (e.g. a cue ball).

In some embodiments, the device may also include an extension element that has a groove or other type of aperture that is configured as a rest for a cue stick or other cue element for over ball striking. The aperture defined by the extension element may be configured transverse to the aperture defined by the rest. For instance, a mouth of the aperture defined by the rest that is configured to receive a cue stick may face upwardly to receive a cue stick when the mouth of the aperture defined by the extension element faces sidewardly (e.g. leftwardly or rightwardly) to receive a cue stick and the mouth of the aperture defined by the rest that is configured to receive a cue stick may face sidewardly to receive a cue stick when the mouth of the aperture defined by the extension element faces upwardly to receive a cue stick.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a stoker's aid are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Figure 1:
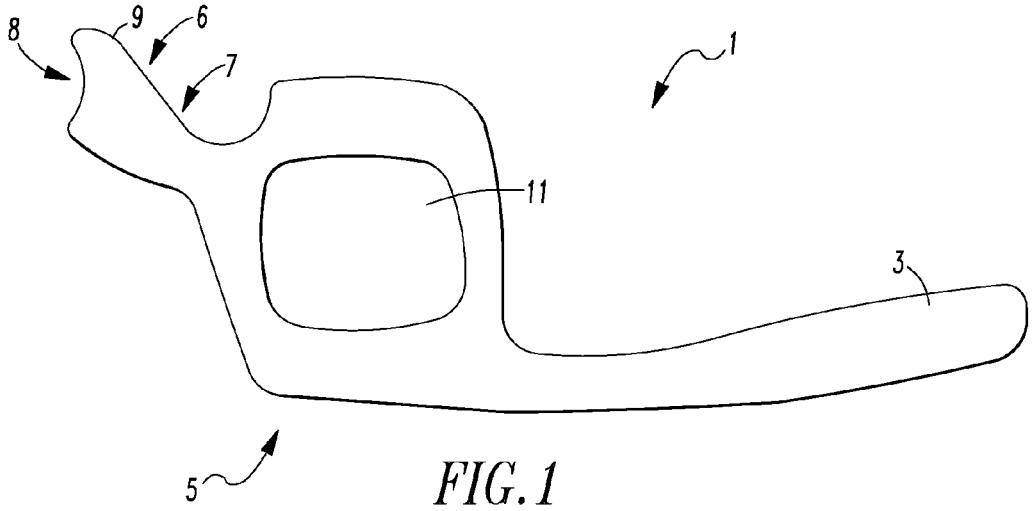
FIG. 1 is a side view of an exemplary embodiment of our device.
Figure 2:
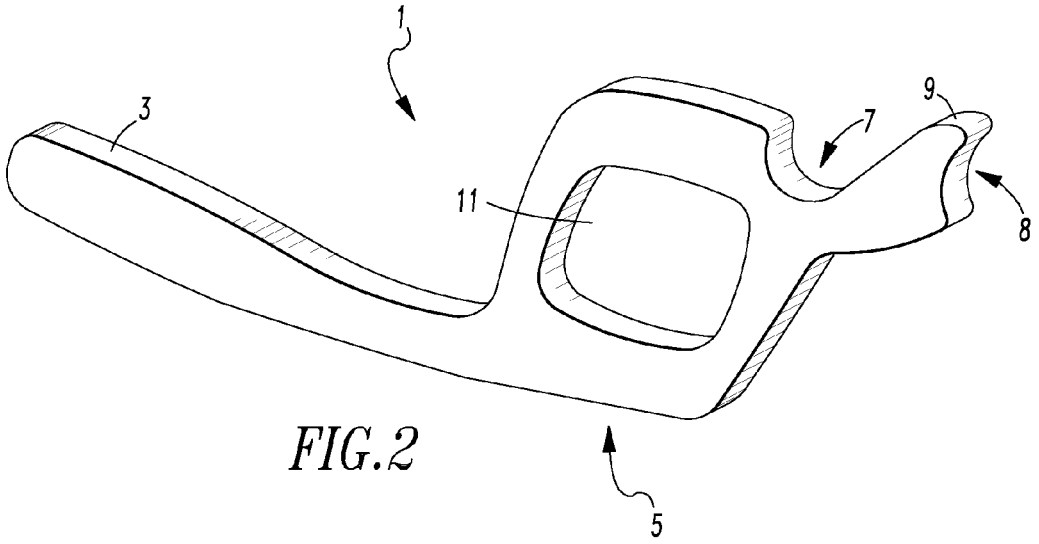
FIG. 2 is a perspective view of the exemplary embodiment of our device.

An exemplary embodiment of our device 1 that is usable to help assist a user in moving a cue stick, pool cue, or other type of cue member sized and configured to strike a ball for a game of pool or billiards is shown in FIGS. 1-4. The device 1 includes a stabilizer element 3 that is attached to a ring element 5. The ring element 5 is attached to a rest 6. The rest 6 can define a first aperture 7 adjacent to a side, a top, or a bottom of the ring element. An extension member 9 is attached to at least one of the rest 6 and the ring element 5 and defines a second aperture 8. A tip of the extension member 9 or an outermost portion of the extension member may define the second aperture 8. The ring element 5 may be positioned between the stabilizer element 3 and the rest 6. The rest 6 may be positioned between the ring element 5 and the extension member 9.

In some embodiments, the entire device 1 can be a unitary structure that is formed of a polymeric material. For instance, the entire structure of the device may be molded from a polymeric material (e.g. a type of plastic or a type of elastomeric material). In other embodiments, the different component may be affixed to each other by at least one type of fastening mechanism (e.g. fasteners, connectors, adhesive, etc.). For example, the rest 6 may be integral to a portion of the ring element and/or be defined by a portion of the ring element and the extension member 9 may be a projection that extends from the rest 6. In other embodiments, the rest 6 may be attached to the ring element 5 between the ring element 5 and the extension member 9. The extension member 9 may extend from the rest 6 and/or the ring element 5. In some embodiments, the extension member 9 may be attached to the rest 6 and/or the ring element 5 or be integral to the rest 6 and/or the ring element 5.

The ring element 5 may be an annular structure that defines an inner aperture 11 that is sized so that at least one finger may be passed through that inner aperture 11. The inner aperture may be an inner opening, inner passage or other type of inner hole that is defined by the ring element as a circular hole, a polygonal shaped hole, or an elliptical shaped hole. In some embodiments, the shape of the ring element may be a polygonal shape (e.g. a square, rectangle, hexagon, etc.) or may be a circular or elliptical shape. In some embodiments, the inner aperture 11 defined by the ring element 5 may be oblong in shape to facilitate a user inserting their pointer finger or other finger through the inner aperture 11 so that the stabilizer element 3 may be rotated around that finger until it is in contact with the palm of that person's hand for being held, grasped or otherwise controlled by the user.

In some embodiments, the ring element may have a covering placed along the periphery structure defining the inner aperture 11 to aid the comfort of a user's finger that may be passed through that aperture. The covering could be cloth or another type of covering. A pad such as a rubber or gel pad could also be positioned between that covering and the ring element to aid a user's comfort.

The stabilizer element 3 may be an elongated member. For instance, the stabilizer element may be a rod-like shape, a tubular shape, an elongated bar, a rail, or other type of elongated member having a polygonal cross-section, circular cross-section or elliptical cross-section. In some embodiments, the thickness and/or width of the stabilizer element may vary along the length of the stabilizer element 3 that extends away from the ring element 5. In other embodiments, the thickness and/or width may be uniform. In some embodiments, the stabilizer element 3 may be hollow or may include hollow portions. In some contemplated embodiments, the stabilizer element can include a grip covering such as a gel-type covering, a felt covering, or a cloth covering. A pad may be positioned between the stabilizer element and such a covering (e.g. a rubber pad, a gel pad, etc. to provide additional comfort to a user's grip of the stabilizer element 3.

Figure 3:
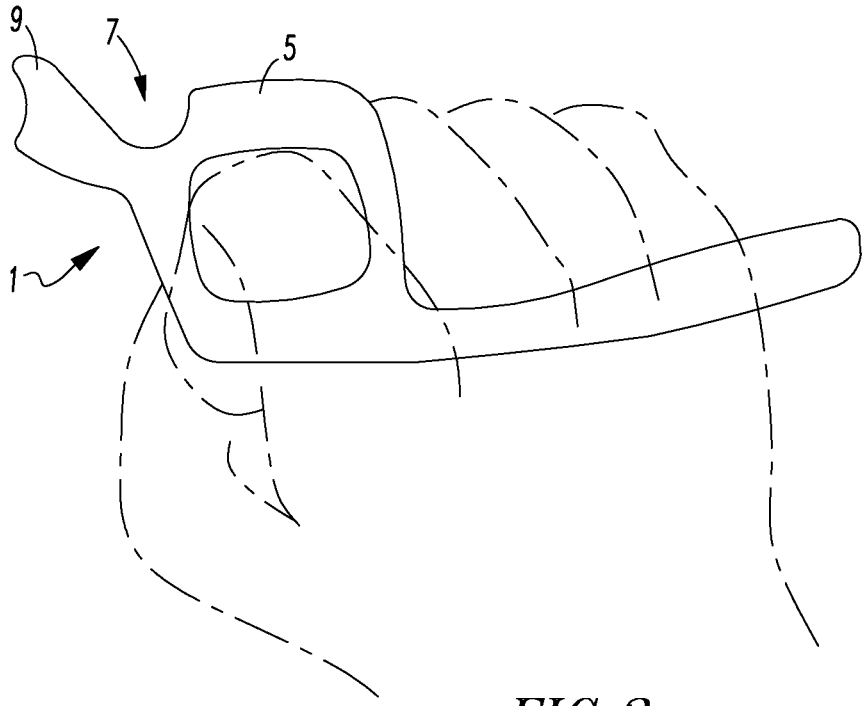
FIG. 3 is a perspective view of the exemplary embodiment of our device being grasped by a user in a first position in which a mouth of the aperture of a rest faces upwardly and the mouth of an aperture defined by the extension element faces sidewardly.

The stabilizer element 3 can be configured so that a user may hold the device 1 by passing at least one finger through the inner aperture 11 of the ring element 5 and grasping the stabilizer element 3 with one or more other fingers that curve inwardly into the palm of the user's hand as shown in FIG. 3. For instance, the pointer finger of a user may pass through the inner aperture 11 and the middle finger, fore finger, and/or pinky of the user may grasp the stabilizer element 3 to hold the device 1. The user may then move the device 1 from the first position shown in FIG. 3 to the second position shown in FIG. 4 and/or to other positions as necessary for use in aiding the user to move a cue stick or other elongated cue element for striking a ball during a game of billiards or pool.

The device 1 can also be controlled by a user without grasping the stabilizer element with his or her fingers. For instance, a user may choose to control the device 1 by passing a finger through the inner aperture 11. The finger may be straight or relatively straight and may extend away from the palm of the user's hand. The user can then manipulate the stabilizer element 3 to cause the stabilizer element to rotate about the finger positioned through the inner aperture 11 until the stabilizer element 3 is located in the palm of the user's hand or adjacent the palm of the user's hand. The inner aperture 11 can have an oblong shape or have a curved outer shape at different segments of the inner aperture 11 to help facilitate the rotating of the stabilizer element about the user's finger. The shape of the inner aperture 11 can be structure to also help push the user's finger further through the inner aperture 11 to facilitate a tighter fit between the finger and the ring element as the stabilizer element 3 is rotated about the user's finger to be positioned in the user's palm of his or her hand or near the palm of the user's hand as can be appreciated from FIGS. 5 and 6.

Figure 4:
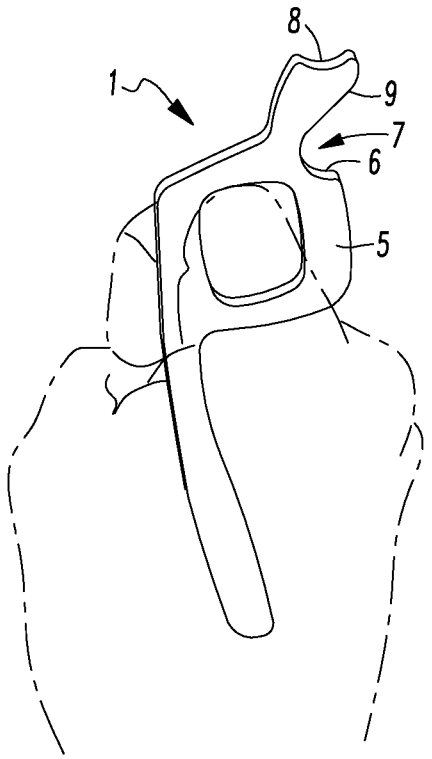
FIG. 4 is a perspective view of the exemplary embodiment of our device being grasped by a user in a second position in which a mouth of the aperture of a rest faces sidewardly and the mouth of an aperture defined by the extension element faces upwardly.
Figure 5:
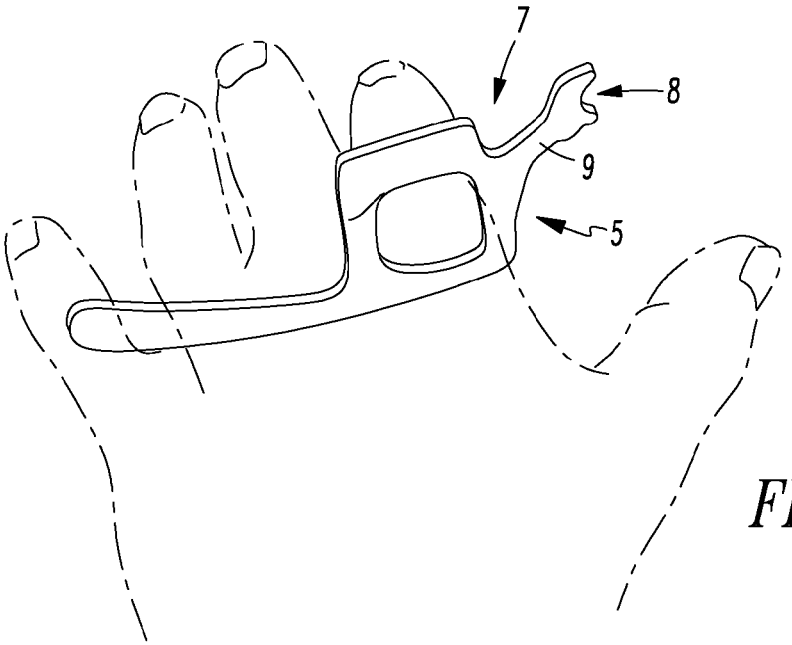
FIG. 5 is a perspective view of the exemplary embodiment of our device being controlled by a user in a first position in which a mouth of the aperture of a rest faces upwardly and the mouth of an aperture defined by the extension element faces sidewardly.
Figure 6:
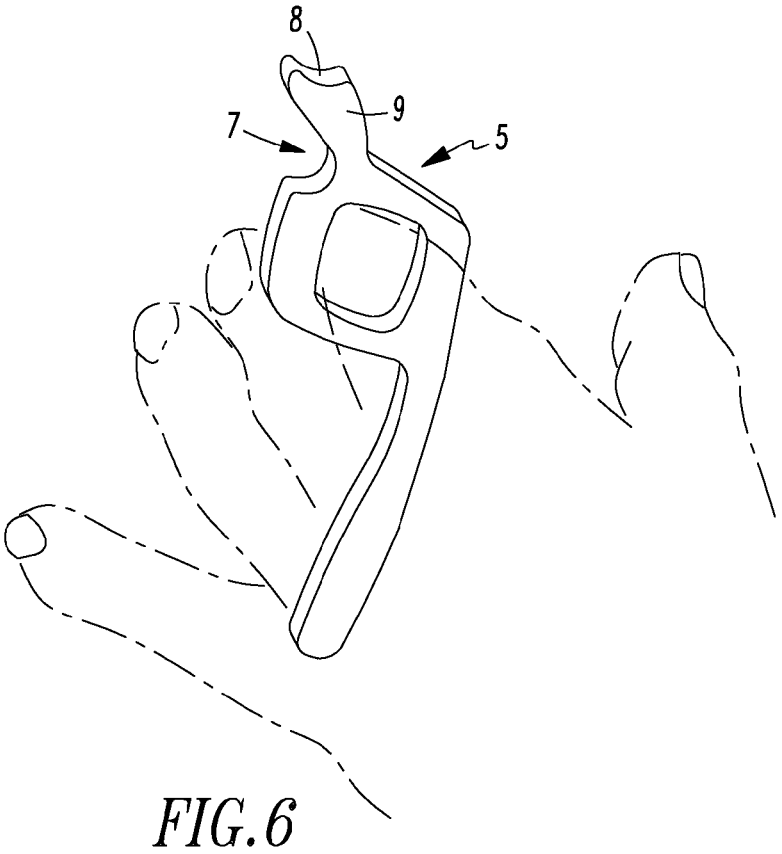
FIG. 6 is a perspective view of the exemplary embodiment of our device being controlled by a user in a first position in which a mouth of the aperture of a rest faces upwardly and the mouth of an aperture defined by the extension element faces sidewardly.

As shown in FIGS. 5-6, a user may use the palm of his or her hand or the base portions of the user's fingers near the palm of the user's hand to contact the stabilizer element 3 as the user's fingers extend forwardly or outwardly away from the palm of the user's hand to help stabilize and support the hand and the device 1. The fingers may extend linearly or extend generally linearly and outwardly to help support the position of the hand on a surface (e.g. a pool table). This type of holding of the device may provide more stability as compared to the grasping of the stabilizer with multiple fingers that are curved inwardly into the palm of the hand to hold the stabilizer element 3 as shown in FIGS. 3 and 4. A user may then slide a cue stick or other type of cue member or cue element along the first aperture 7 or second aperture 8 for striking a ball during a game of pool by controlling the device as shown in FIGS. 5 and 6. The surface on which the user's hand rests (e.g. the top of the pool table) and the user's hand may contact the stabilizer element when the cue stick or other type of cue element is slide along the first aperture 7 or second aperture 8 to keep the device 1 stable and/or non-moving during such use. The user may adjust the position of the device 1 as needed to facilitate the aim of his or her shot. For instance, the user may adjust the position of the device between the first position shown in FIG. 5 and the second position shown in FIG. 6 for a particular shot or for use in different shots during a game of billiards.

The first aperture 7 defined by the rest 6 may have a mouth that faces in a first direction that is shaped to receive a cue stick or other type of elongated cue element used to strike a ball. The second aperture 8 may have a mouth that faces in a second direction that is sized and shaped to receive the cue stick or other type of elongated cue element used to strike a ball. The first direction may be upwardly and the second direction may be sidewardly when the device is held in the first positions shown in FIGS. 3 and 5. The first direction may be sidewardly and the second direction may be upwardly when the device 1 is held in the second positions shown in FIGS. 4 and 6. The first direction may face a direction that is between 60-120 degrees, 80-100 degrees, 75-95 degrees, or 80-90 degrees, relative to the first direction. In other embodiments, the first direction may be perpendicular to the second direction or substantially perpendicular to the second direction (e.g. within 5 degrees of being perpendicular, within 3 degrees of being perpendicular, within 1 degree of being perpendicular, etc.).

The first aperture 7 and second aperture 8 may each be sized and configured so that the aperture has a mouth sized to receive a cue stick or other type of cue element that is in communication with a groove, furrow, slot, channel, or other type of opening that is sized and configured so that the cue stick or cue element is slideable along that aperture when the stick or element is moved to strike a ball. When sliding along the first aperture 7 or second aperture 8, the cue stick or other type of cue element may be in contact with the rest 6 or extension member defining that aperture as the cue stick or other type of cue element is moved. This contact with the cue stick or other type of cue element can permit the sliding motion of the cue stick or cue element to be guided by the rest defining the first aperture and/or the extension member 9 defining the second aperture 8.

In some embodiments, it is contemplated that the portion of the rest 6 that defines the first aperture 7 may include a covering or have an outer surface defined by the material that the rest 6 is composed of to facilitate easy sliding of a cue stick. It is also contemplated that the portion of the extension member 9 that defines the second aperture 8 may also include a covering or have an outer surface defined by the material the extension member 9 is composed of to facilitate easy sliding of a cue stick in some embodiments of the device 1.

A user may use an embodiment of the device 1 during a game of billiards played on a billiards table with a number of different billiards balls (e.g. eight ball, nine ball, ten ball, straight pool, snooker, etc.). In some embodiments, the user may place one of the user's fingers through the inner aperture 11 and have one or more other fingers used to grasp the stabilizer element 3 to help position the device and hold the device steady. In other embodiments, the user may place one finger through inner aperture 11 and have all the fingers on that hand extend outwardly from the palm of the user's hand to help hold the stabilizer element adjacent the palm of the user's hand while using the user's outstretched fingers to stabilize the hand and device on the pool table or other structure. For instance, the user may place the hand holding the device 1 on the tabletop surface of the billiards table or on a rail or other structure adjacent to that table near a ball the user desire's to strike with a cue stick or other cue element to move that ball during the game. Once the device 1 is in a desired position adjacent a ball to be hit, the user may pass the user's cue stick or other cue element along the first aperture 7 defined by the rest 6 or along the second aperture 8 defined by the extension member 9 to guide motion of the cue stick as it is moved toward the ball the user desired to strike with the cue stick or other type of cue element. During the game, the user may adjust the device from the first position to the second position for use in one shot and can subsequently move the device from the second position to the first position for use in another shot or to change his or her mind on how to use the device to assist with the first shot. The user may use the device 1 for each turn the user may take during a game of pool.

The first and second apertures 7 and 8 defined by the rest 6 and extension member 9 can be configured to help guide the user's motion of the cue stick or other cue element so that the user has a more reliable aim and learns the muscle memory necessary to make more accurate shots when not using the device. The device 1 may therefore help teach a user how to accurately use a cue stick to strike a ball during a billiards game and may also be used to assist a user in such a game.

It should be appreciated that variations to the device 1 may be made to meet a particular set of design criteria. For instance, the material that the device is composed of may be a metal, a polymeric material, a composite material or other type of material. As another example, the ring element may be any type of structure having an inner aperture defined therein. As yet another example, the size of the cue stick that the first and second apertures are sized to receive may be configured for only a certain type or style of cue stick or may be large enough to receive many different sizes of cue stick. As yet another example, the size and shape of the device 1 can be any of a number of different sizes to accommodate different sized users. For instance, embodiments of the device can be configured so that there are different sized devices sized for different users such as a first smaller sized device for children, a second sized device for teenagers, a third sized device for small sized men or women, a fourth sized device for average sized women or men, and a fifth sized device for large men or women.

Therefore, it should be understood that while certain exemplary embodiments of our device that is usable to help assist a user in moving a cue stick or other cue member sized and configured to strike a ball for a game of pool or billiards (e.g. a stroker's aid) and methods of making and using the same have been discussed and illustrated herein, it is to be distinctly understood that the invention is not limited thereto but may be otherwise variously embodied and practiced within the scope of the following claims.

The invention claimed is:

1. A method of moving a cue member comprising:

providing a device comprising:

a stabilizer element, the stabilizer element comprising an elongated member, a ring element attached to the stabilizer element, and a rest attached to the ring element, the rest defining a first aperture adjacent the ring element, the first aperture having a mouth that faces a first direction such that a cue member is passable into the mouth of the first aperture and is slideable within the first aperture;

an extension member attached to at least one of the rest and the ring element such that the extension member extends away from the rest and the ring element and also extends away from the stabilizer element, the extension member defining a second aperture at a distal end of the extension member that is positioned further away from the ring element than the first aperture, the second aperture having a mouth that faces a second direction that is opposite the first direction that is sized and shaped to receive a cue member such that the cue member is passable into the mouth of the second aperture and is slideable within the second aperture, holding the device by passing at least one finger through the ring element;

sliding the cue member along the first aperture to hit a ball with the cue member while holding the device; and sliding the cue member along the second aperture to hit a ball with the cue member while holding the device.

2. The method of claim 1, wherein the extension member is positioned adjacent a first side of the ring element and extends away from the first side of the ring element and the stabilizer element is positioned to extend away from a second side of the ring element that is opposite the first side of the ring element.

3. The method of claim 2, wherein the first direction is transverse to the second direction.

4. The method of claim 3, wherein the first direction is oriented at least 75-90 degrees relative to the second direction.

5. The method of claim 3, wherein the first direction is perpendicular to the second direction.

6. The method of claim 3, wherein the first direction is sidewardly and the second direction is upwardly.

7. The method of claim 3, wherein the stabilizer element, the ring element and the rest are components of a unitary structure composed of a polymeric material and a length of the elongated member of the stabilizer element extends away from the extension member, the ring element and the rest.

8. The method of claim 3, wherein the ring element is an annular shape that is circular or polygonal in shape and wherein the rest is at least partially defined by a portion of a body of the ring element.

9. The method of claim 3, wherein the ring element is polygonal in shape, circular in shape, or elliptical in shape and has a central aperture that is sized so that the at least one finger is passable through that central aperture and wherein the cue member is a pool cue or a cue stick.

10. The method of claim 2, comprising:

moving the device from a first position in which the mouth of the first aperture faces upwardly to receive the cue member and a mouth of the second aperture faces sidewardly to a second position in which the mouth of the second aperture faces upwardly to receive the cue member and the mouth of the first aperture faces sidewardly.

11. The method of claim 10, wherein the sliding of the cue member along the second aperture to hit the ball with the cue member while holding the device occurs while holding the device in the second position.

12. The method of claim 1, wherein the stabilizer element, the ring element and the rest are components of a unitary structure composed of a polymeric material.

13. The method of claim 1, wherein the ring element is an annular shape that is circular or polygonal in shape.

14. The method of claim 1, wherein the ring element is polygonal in shape, circular in shape, or elliptical in shape and has a central aperture that is sized so that a finger of a user is passable through that central aperture.

15. The method of claim 1, wherein a hand of a user has the at least one finger, the method comprising:

rotating the stabilizer element about the at least one finger of the user after the at least one finger is passed through the ring element until the stabilizer element is in the palm of a hand;

controlling the device such that fingers of the hand extend outwardly from a palm of the hand.

16. The method of claim 15, comprising:

using outstretched fingers of the hand to stabilize the device adjacent a pool table such that the stabilizer element is held adjacent a palm of the hand while the outstretched fingers stabilize the hand and the device on the pool table to stabilize the device before sliding the cue member along the first aperture to hit the ball with the cue member while holding the device.

17. The method of claim 16, comprising:

moving the device from a first position in which the mouth of the first aperture faces upwardly to receive the cue member and a mouth of the second aperture faces sidewardly to a second position in which the mouth of the second aperture faces upwardly to receive the cue member and the mouth of the first aperture faces sidewardly.

18. The method of claim 17, wherein the cue member is a cue stick or a pool cue.

19. The method of claim 18, wherein the extension member is positioned adjacent a first side of the ring element and extends away from the first side of the ring element and the stabilizer element is positioned to extend away from a second side of the ring element that is opposite the first side of the ring element.

20. The method of claim 19, wherein the using of the outstretched fingers of the hand to stabilize the device adjacent the pool table such that the stabilizer element is held adjacent the palm of the hand while the outstretched fingers stabilize the hand and the device on the pool table to stabilize the device before sliding the cue member along the first aperture to hit the ball with the cue member while holding the device is performed such that the stabilizer element is held in the palm of the hand.

* * * * *